US005456624A

United States Patent [19]

Moore et al.

[11] Patent Number: 5,456,624

[45] Date of Patent: Oct. 10, 1995

[54] SPARK PLUG WITH FINE WIRE RIVET FIRING TIPS AND METHOD FOR ITS MANUFACTURE

[75] Inventors: David J. Moore, Fostoria; William A. Barrett, Bradner; Thomas C. Painter, Fostoria, all of Ohio

[73] Assignee: AlliedSignal Inc., Morristown, N.J.

[21] Appl. No.: 214,727

[22] Filed: Mar. 17, 1994

[51] Int. Cl.[6] ..... H01T 21/02

[52] U.S. Cl. ..... 445/7; 313/142; 219/93

[58] Field of Search ..... 445/7; 313/141, 313/142; 219/93

[56] References Cited

U.S. PATENT DOCUMENTS

| | | | |
|---|---|---|---|
| 2,127,685 | 8/1938 | Greulich | 219/93 |
| 2,955,222 | 10/1960 | Beesch | 445/7 X |
| 4,122,366 | 10/1978 | von Stutterheim et al. | 313/141 |
| 4,414,483 | 11/1983 | Nisho | 313/141 X |
| 4,540,910 | 9/1985 | Kondo et al. | 313/141 X |
| 4,581,558 | 4/1986 | Takamura et al. | 313/141 |
| 4,670,684 | 6/1987 | Kagawa et al. | 313/141 |
| 4,684,352 | 8/1987 | Clark et al. | 445/7 |
| 4,699,600 | 10/1987 | Kondo | 445/7 |
| 4,705,486 | 11/1987 | Myers et al. | 445/7 |
| 4,743,793 | 5/1988 | Toya et al. | 113/141 |
| 4,786,267 | 11/1988 | Toya et al. | 445/7 |
| 4,840,594 | 6/1989 | Moore | 313/141 |
| 4,881,913 | 11/1989 | Mann | 445/7 |
| 4,893,051 | 1/1990 | Kondo | 313/141 |
| 4,904,216 | 2/1990 | Kagawa et al. | 445/7 |
| 4,963,112 | 10/1990 | Benedikt et al. | 445/7 |
| 5,179,313 | 1/1993 | Eves et al. | 445/7 X |

FOREIGN PATENT DOCUMENTS

| | | |
|---|---|---|
| 0171994A1 | 2/1986 | European Pat. Off. . |
| 0518707A2 | 12/1992 | European Pat. Off. . |
| 3-98279 | 4/1991 | Japan . |
| 3-110781 | 5/1991 | Japan . |

*Primary Examiner*—Kenneth J. Ramsey
*Attorney, Agent, or Firm*—Leo H. McCormick, Jr.

[57] ABSTRACT

A spark plug for an internal combustion engine is provided with a fine wire platinum firing tip. The platinum tip is preformed in a rivet before being welded to the center electrode during manufacture of the spark plug. Accordingly, the amount of platinum required is closely controlled,

8 Claims, 2 Drawing Sheets

SPARK PLUG WITH FINE WIRE RIVET FIRING TIPS AND METHOD FOR ITS MANUFACTURE

This invention relates to a spark plug for an internal combustion engine, and a method for manufacturing such spark plugs.

Spark plugs are a critical component in an internal combustion engine to assure proper engine performance. Spark plugs include a metal housing which is threaded for installation into the engine, a ground electrode extending from the housing, an insulator (usually manufactured of a ceramic material) carried by the housing, and a center electrode within the insulator, one end of which projects from the end of the insulator and defines a predetermined gap with the ground electrode. When the spark plug is fired, the spark is generated across the gap. More recently, spark plugs have been designed with a fine wire tip made of a noble metal (platinum or a platinum alloy) that has significantly improved engine performance and significantly increased spark plug life. Platinum fine wire spark plugs have a service life of 100,000 miles, improve cold starting, acceleration, and fuel economy of the engine, as comparable to conventional spark plugs not having a platinum firing tip. The extremely fine wire at the firing tip of the spark plug (generally having a diameter of 0.025–0.035 inches) concentrates the electrical energy used to fire the spark plug, thus increasing spark efficiency.

A prior art platinum tip, fine wire spark plug is disclosed in European patent application 171994. This document discloses a platinum tip spark plug which applies the platinum tip to the end of the center electrode by resistance welding length of platinum wire to the electrode. In this process, however, it is difficult to control the amount of material used. Since platinum is extremely expensive, it is essential that the amount of platinum is minimized and closely controlled. Another problem with this prior art process is that initial contact between the platinum wire and the center electrode is over the entire diameter of the platinum wire. It is desirable to provide initial contact between the wire and the electrode across the smallest possible area (point contact preferred), to thereby concentrate the electrical energy used to weld the two members together, thereby improving welding efficiency. According to the present invention, a length of platinum wire, having the same diameter as the desired firing tip, is formed into the shape of a rivet, with the wire forming a shank extending from a hemispherical head formed on the length of wire by any known process, such as by a high speed ball former. Since the firing tip for each spark plug is preformed as the rivet, the amount of material used in each firing tip can be very closely controlled. Furthermore, the hemispherical shape of the rivet head engages The center electrode initially at a point during the welding process, thereby improving the welding efficiency as described above.

These and other advantages of the present invention will become apparent from the following description, with reference to the accompanying drawings, in which.

Figure 1:
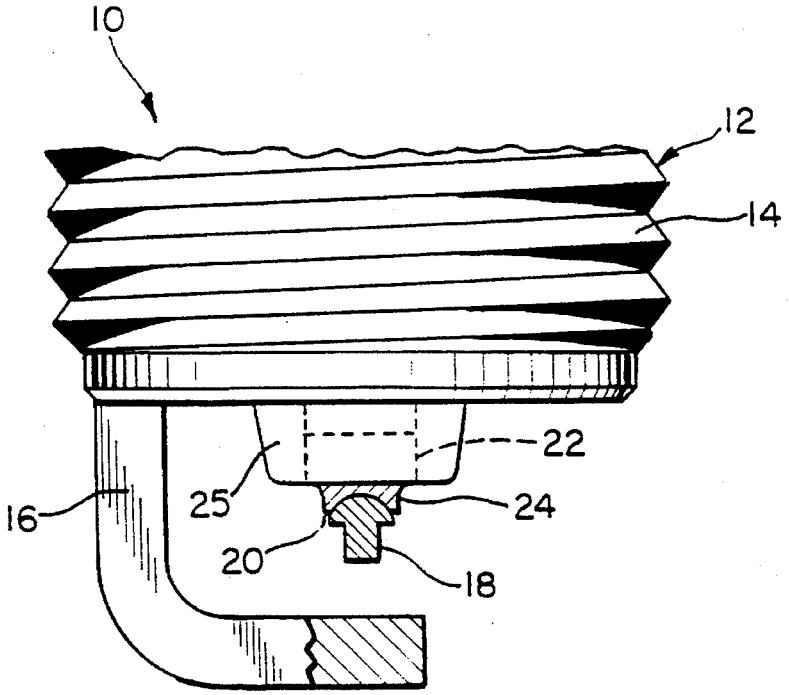
FIG. 1 is a fragmentary view, partly in section, of a spark plug made pursuant to the teachings of the present invention.
Figure 5:
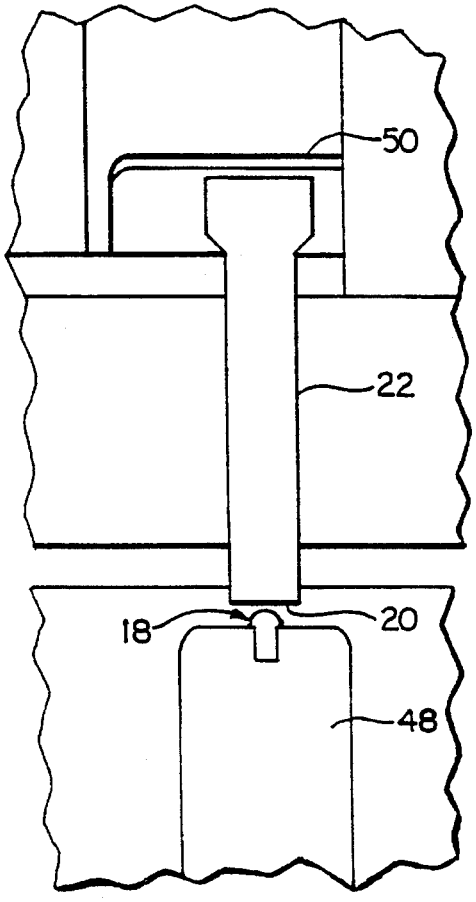
Figure 7:
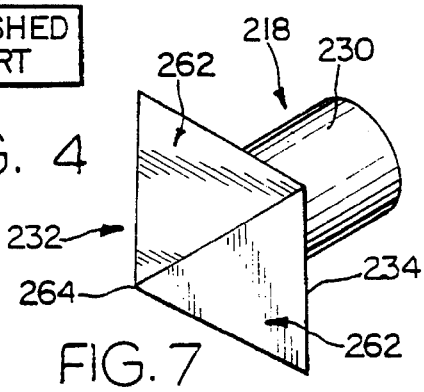
Figure 6:
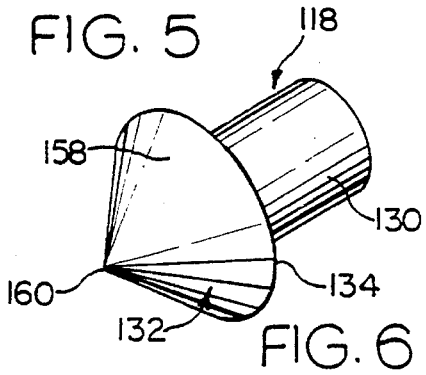

FIG. 5 is a schematic illustration of a resistance welding machine with a firing tip of the rivet configuration according to the present invention and the center electrode illustrated in the positions they assume just before the rivet is brought into welding contact with the electrode; and FIGS. 6 and 7 are views in perspective, each of which illustrates an alternate configuration of the rivet used in the spark plug illustrated in FIG. 1.

Figure 2:
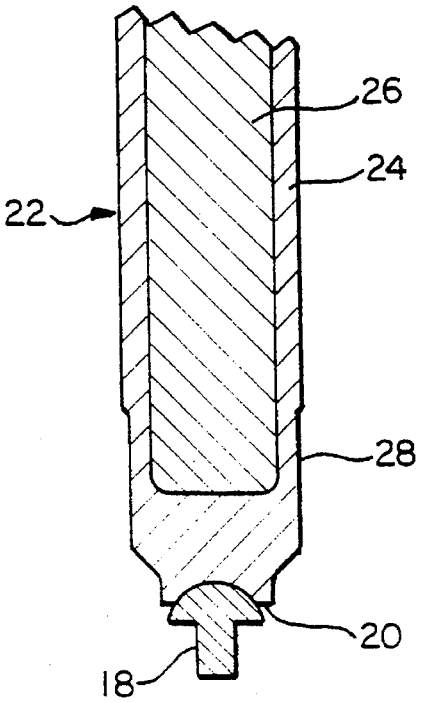
FIG. 2 is a cross-sectional view of the center electrode used in the spark plug illustrated in FIG. 1.

Referring now to the drawings, a spark plug generally indicated by the numeral 10 includes an annular metal housing 12 which is threaded as at 14 for installation into an internal combustion engine (not shown) A ground electrode 16 extends from the housing 12 to define a firing gap with a center electrode 22. Center electrode 22 includes a rivet 18 of noble metal secured to the end face 20 of an outer sheath 24 which projects from an insulator 25, which is mounted within the housing 12. Referring to FIG. 2, the center electrode 22 includes the outer sheath 24 which receives a copper core 26. The outer sheath 22 terminates in an end section having a necked-down portion 28 which terminates in the end face 20.

Figure 3:
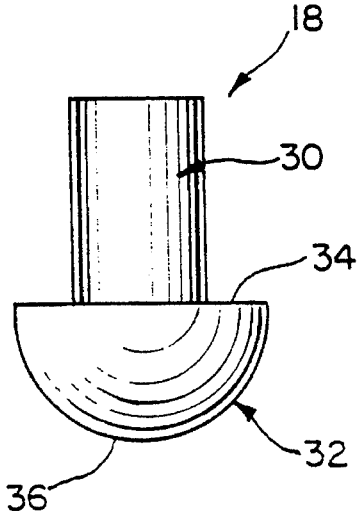
FIG. 3 is an enlarged view of the rivet which is preformed for attachment to the center electrode of FIG. 2.

Referring now to FIG. 3, the rivet 18 includes a shank portion 30 and a head 32. The shank portion 30 extends from a substantially flat side 34 of the head 32. The other side of the head 32 is a continuously curving, spherical surface 36. Accordingly, the head 32 is substantially hemispherical, and the spherical surface 36 intersects the surface 34 at a circle, the radius of which is substantial equal to the radius of the spherical surface 36. As discussed above, the rivet 18 is made from a noble metal, such as platinum or a platinum alloy. For example, the rivet 18 may be made of an O.D.S. (Oxide Dispersion Strengthened) platinum, available commercially from Englehard Industries, Inc. This alloy contains small amounts (less than 2%) of yttrium oxide, which is added to stabilize the grains of platinum at elevated temperatures. Various other alloys of Iridium/Platinum may be used, with iridium volumes from about 5% to about 20% are alloyed with 95% to 80% platinum. Finally, Nickel/Platinum alloys may be used, with Nickel volumes from 5% to 50% alloyed with 95% to 50% volumes of platinum. As will be discussed hereinafter, the rivet 18 is made of a length wire of predetermined diameter such that the diameter of the shank 30 of the finished rivet 18 is equal to the diameter of the wire from which the rivet is made. Preferably, the diameter of the shank 30 is 0.031 inches, but varying diameters from 0.025 inches to 0.035 inches have been used. The length of the shank 30 is in the range of from 0.025 inch to 0.040 inch.

Referring now to the alternate rivet configurations of FIGS. 6 and 7, elements the same or substantially the same as those of the preferred embodiment retain the same reference character, but are increased by 100 and 200 respectively. FIG. 6 illustrates a rivet 118 similar to the rivet 18 of FIG. 3, but in which the head 132 is formed as a conical surface 158 terminating in an apex 160. FIG. 7 illustrates a rivet 218 similar to the rivets 18 and 118 of FIGS. 3 and 6, but in which the head 232 is formed as a pyramidal surface, consisting of four triangular faces 262 which converge at an apex 264. As will be explained hereinafter, it is important that during the welding of the rivet 18, 118, or 218 to the center electrode 22, it is important that the initial contact between the rivet and the electrode be made at substantially a single point, to thereby concentrate the electrical welding energy to assure a proper and efficient weld. The conical rivet head 118 and pyramidal rivet head 218 initially engage the center electrode at their apex 160 or 264, thereby assuring point contact. In the preferred embodiment of FIG. 3, any point on the spherical surface 36 will initially engage the center electrode 22 at a point contact.

Figure 4:
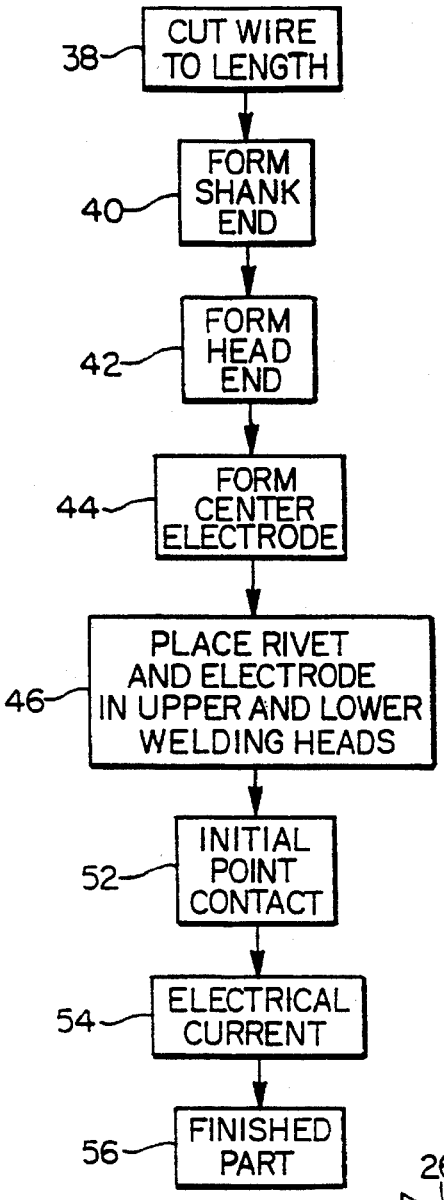
FIG. 4 is a flow chart illustrating the process by which the firing tip of noble material is formed and attached to the center electrode as illustrated in FIG. 2.

Referring now to FIG. 4, the process by which the center electrode 22 is formed will be described,. As indicated at 38, a length of wire made from platinum or one of the aforementioned platinum alloys is cut to a predetermined length. As indicated by 40, the shank end 30 of the rivet is then finished and formed, and, as indicated at 42, the head of the rivet is formed. The head is formed in a conventional high speed ball former and the general process is familiar to anyone skilled in the art. The center electrode 22 is then formed, as indicated at 44. Formation of the center electrode 22 may be formed as described in U.S. Pat. No. 4,705,486.

As indicated at 46, the electrode 22 and rivet 18 are clamped respectively in lower welding head 48 and upper welding head 50 (indicated schematically in FIG. 5) of a conventional electric resistance welding machine wherein the upper welding head 50 is movable relative to the lower welding head 48. The upper welding head 50 is then moved toward the lower welding head 48 until the spherical surface 36 makes an initial point contact with end face 20 of the electrode 22, as indicated at 52 on FIG. 4. An electrical current is then applied through the parts 18, 22, which varies from 500 to 1,000 amps and the upper welding head 50 forces the part 22 against the rivet 18 with a force that varies from about 10 to about 30 pounds. This welding operation generates an alloying of the noble metal of the rivet 18 and the sheath 24 at the weld interface. The surface 36 penetrates into the face 20 a depth that is controlled by varying the current and the applied force between the two parts during application of the current, and embeds the spherical surface 36 into the sheath 24 about 0.006 inch to about 0.012 inch deep, thereby forcing the material of the sheath 24 which is displaced by the head 32 to flow around the spherical surface 36 to capture the rivet. The finished part is then removed from the welding machine, as indicated at 56 in FIG. 4.

We claim:

1. A method of manufacturing a spark plug having a center electrode with a fine wire tip of a noble metal extending from one end of said center electrode, said fine wire tip being made by cutting a wire made of said noble metal to a predetermined length, forming said length of wire into a rivet, forming said center electrode from a material other than said noble metal, welding said rivet to one end of said center electrode by initially engaging said rivet with said center electrode at substantially a single point as said welding step is initiated.

2. Method of manufacturing a spark plug as claimed in claim 1, wherein said rivet has a shank and a head, the step of forming the wire into a rivet including the step of forming a head having a diameter greater than the diameter of said wire, said head having an engagement surface for engagement with said center electrode, a portion of said wire extending from said head to define the shank of said rivet.

3. Method of manufacturing a spark plug as claimed in claim 1, wherein the step of forming the wire into a rivet includes the step of forming a head having a spherical surface for engagement with the center electrode.

4. Method of manufacturing a spark plug as claimed in claim 1, wherein the step of forming the wire into a rivet includes the step of forming a head having a conical surface terminating in an apex, and engaging said apex with the center electrode during welding.

5. Method of manufacturing a spark plug as claimed in claim 1, wherein the step of forming the wire into a rivet includes the step of forming a head having a pyramidal surface terminating in an apex, and engaging said apex with the center electrode during welding.

6. Method of manufacturing a spark plug as claimed in claim 1, wherein the step of welding said rivet to the electrode is by electric resistance welding effected by placing the center electrode and the rivet in upper and lower welding heads, bringing the rivet and center electrode into engagement with one another, and causing an electrical current of predetermined amperage to flow through said center electrode and the rivet while the rivet and center electrode are held into contact with one another.

7. Method of manufacturing a spark plug as claimed in claim 6, wherein the step of welding said rivet to the electrode includes the step of forcing the center electrode and the rivet against each other with a predetermined force while causing said current to flow through both the rivet and the center electrode.

8. A spark plug made from the method of manufacture as recited in claim 1.

* * * * *